US006216374B1

(12) United States Patent
Lawrence

(10) Patent No.: US 6,216,374 B1
(45) Date of Patent: Apr. 17, 2001

(54) BANNER WITH IMPROVED SUPPLEMENT SIGNAGE POCKET

(75) Inventor: Gary L. Lawrence, 8036 Bricker Rd. NW., Massillon, OH (US) 44646

(73) Assignee: Gary L. Lawrence, Massillon, OH (US)

( * ) Notice: Subject to any disclaimer, the term of this patent is extended or adjusted under 35 U.S.C. 154(b) by 0 days.

(21) Appl. No.: 09/396,566

(22) Filed: Sep. 15, 1999

(51) Int. Cl.[7] ..... G09F 19/00
(52) U.S. Cl. ..... 40/604; 40/611; 40/776
(58) Field of Search ..... 40/604, 775, 776, 40/611, 617, 124.2, 704

(56) References Cited

U.S. PATENT DOCUMENTS 3,339,303 * 9/1967 Anderson et al. ..... 40/704
4,937,962 * 7/1990 Hornblad ..... 40/604
5,898,962 * 5/1999 McNeal ..... 40/776

FOREIGN PATENT DOCUMENTS

948165 * 5/1974 (CA) ..... 40/159.2

* cited by examiner

*Primary Examiner*—Cassandra H. Davis
(74) *Attorney, Agent, or Firm*—Hudak & Shunk Co., L.P.A.

(57) ABSTRACT

A method and product resulting from employing radio frequency electric energy for heat-sealing a thermoplastic pouch to a thermoplastic sheet or banner to provide a banner with an improved supplemental signage pocket affixed thereto. The components of the present invention are, no adhesives and tape free. The product is formed by utilizing a heating sheet heated by RF energy to seal the banner to the pocket. A barrier is placed in said pocket to protect one wall of the pocket from being sealed to the banner.

13 Claims, 3 Drawing Sheets

BANNER WITH IMPROVED SUPPLEMENT SIGNAGE POCKET

FIELD OF INVENTION

The present invention relates to thermoplastic sheets or banners, desirably made from polyethylene, which contain thermoplastic pouches or bags such as polyethylene, heat bonded thereto. More specifically, the present invention relates to the use of heat-bonding thermoplastic pouches or bags to a banner or sign preferably only in a selected area such as the perimeter of the pouch or bag through the use of radio frequency energy.

BACKGROUND OF THE INVENTION

The present invention relates to indoor and outdoor thermoplastic advertising banners, sheets and signs.

Advertising banners known in the art are typically made from a thermoplastic such as polyethylene, polypropylene, or polyester. In addition to the usual descriptive printing, banners of the prior art have polyvinyl chlorine pouches, pinch type bags or stick-on letters adhesively adhered or taped to the banner on the front side thereof. Numbers or letters are inserted into the pouch or adhered directly to the banner in order to convey to an observer a price or special message about the advertisement on the banner.

It is a problem with the prior art to simply print the desired letters or numbers onto a banner because the prices or other aspects of goods and services constantly fluctuate and can often make the banner obsolete before it can even be hung.

A failing of the prior art vinyl pouches and pinch bags is that the adhesive bond between the pouch and the banner weakens when cold wind hits the thermoplastic banner causing flexing which eventually separates the two components. Vinyl hardens and stiffens in cold, whereas polyethylene does so only minimally and tends to remain softer and more pliable.

Another failing of the prior art is the weakening of the adhesive bond due to differing expansion and contraction rates of the polyvinyl chloride pouch or pinch bag and the banner. Plasticizers used in thermoplastics attack and weaken adhesives used in tape. Also, moisture, dirt, dust or the like is collected in the bond area further hastening separation between adhered layers.

Furthermore, stick-on or taped pouches, pinch bags, lettering or numbering often contains solvents or plasticizers as ingredients of the adhesive which attack the pockets and banners, causing puckering between the two adhered components. This separation allows dust or moisture an entry point to further work at breaking down the adhesive and ultimately can separate the components.

Heretofore, pinch bags, pouches, and the like, have not been heat-sealed to a thermoplastic banner using RF electric energy in order to overcome and avoid the above noted difficulties present in the prior art.

BRIEF DESCRIPTION OF THE DRAWINGS

The drawings relate to the physical objects that they are suppose to depict. Further descriptions and embodiments can also be found in the other parts of the specification.

SUMMARY OF INVENTION

Figure 1:
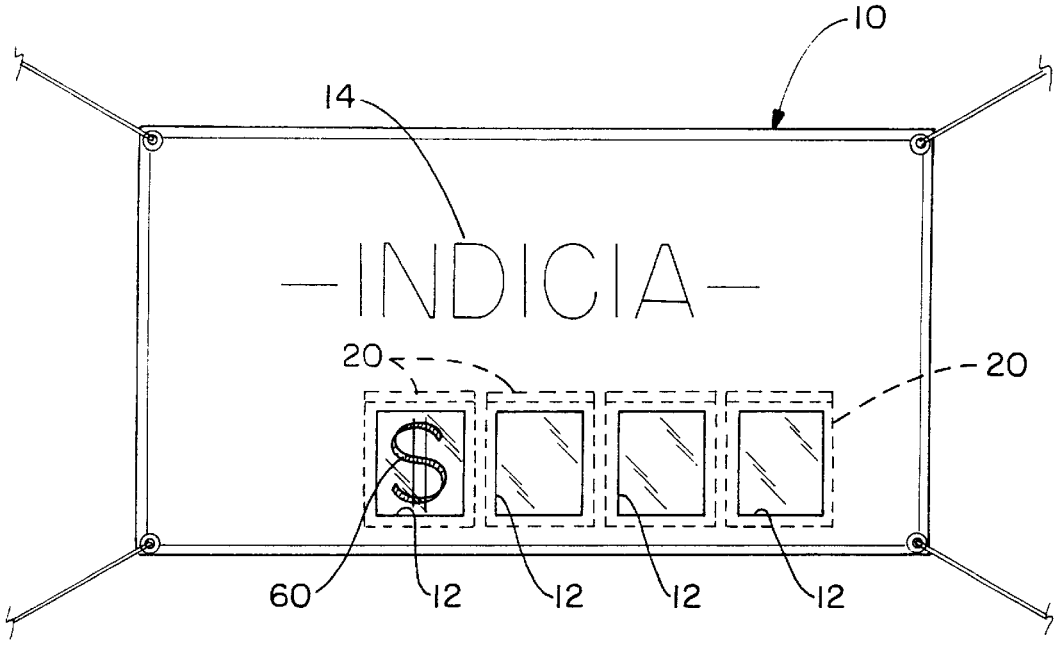
FIG. 1 is a front view of an advertising banner having four pockets sealed to the backside thereof. Windows or holes have been placed or cut into the banner before the pockets were sealed thereto. Also present in FIG. 1 is an example of supplemental signage.

It is therefore an aspect of the present invention to provide a product comprising a thermoplastic banner with a pouch or bag heat-sealed thereto, as well as a method and apparatus for making the same.

It is another aspect of the present invention to provide a thermoplastic banner or sheet, preferably polyethylene, having a pocket such as a pinch bag, pouch, or the like, heat-sealed thereto, preferably by RF energy. The pinch bag, pouch, or the like, can readily be accessed, resealed and optionally filled with contents such as supplemental signage such as replaceable numbers or letter cards.

Still another aspect of the invention involves a process and product thereof for heat sealing a pocket to a window of a thermoplastic banner.

Yet another aspect of the present invention relates to the utilization of a radio frequency die which is applied to selected areas to adhere one side of a bag or pouch to a specific side or area of a banner, and which utilizes a heat absorbing thermoplastic such as polyvinyl chloride to heat bond the pocket or pouch to the banner.

DETAILED DESCRIPTION OF THE INVENTION

A banner such as but not limited to a sheet, film, sign, placard, poster, or any other material has a length and a width defining a surface suitable for advertising purposes and decorative displays, wherein at least a portion of a surface can be imprinted or printed on. The banner can be made out of material that is woven or non-woven. Although the banner can be constructed out of natural fibers such as cotton, wool and the like, preferably the banner is of polymer construction. Examples of suitable polymers include but are not limited to polyolefins such as polyethylene, polypropylene, and also polyvinyl chloride, and polystyrene with polyethylene being preferred. Polyethylene is lightweight, has excellent handling properties and importantly has good tolerance to exposure in ordinary and adverse weather conditions.

Depending on the effect is desired by the designer, the banner can be clear, colored or tinted. Written messages, desirable patterns, designs, or other permanent, nonchanging indicia can be printed directly onto the surface of the banner by various methods of printing known in the art, such as by gravure, flexography, screen-printing, jet printing, web printing, and the like. Multiple printing operations can be utilized to provide multiple or desired designs.

In accordance with the present invention, in order to provide supplemental signage, a pocket having an opening is secured or affixed without the use of adhesives, to the banner, preferably with high frequency electromagnetic energy. The banner is sealed to the pocket directly, applied without adhesives or substantially free of adhesives or glue. Providing a way to facilitate insertion and removal of supplemental signage is an important part of an advertising banner and the present invention. Supplemental signage is defined as an insert card, placard, etc., capable of being received in the signage pocket. For example, supplemental signage can be a printed card bearing numbers, prices, amounts or other desirable descriptive features. A pocket capable of accepting supplemental signage aids one in changing the price of an item or a message frequently, over an extended period of time, or even indefinitely without having to create a new banner.

As used in the present invention, the pocket is a container or other holding elements which is preferably non-rigid. The pocket preferably has at least one opening in order to receive supplemental signage and offer access to the inside of the pocket among other reasons. The pocket may be an ordinary pinch bag, i.e. a re-sealable, rectangular sandwich-type bag, where a pair of overlapping polymer panels have been fused or sealed together along three edges and the remaining edge has a re-openable and re-closeable pinch-type closure is present at the open edge, capable of being pinchably sealed. Alternatively, any type of bag can be used as a pocket, for example, a flap top bag, open top or a metal or plastic slider top bag. The pocket has at least two walls, one of which will be sealed to the banner. The pocket may optionally have a sealable opening. The preferred pocket is re-openable and re-sealable, allowing for change in the contents. The above noted pinch bag is a preferred pocket of the present invention. An example of a pinch type bag is a Ziploc™ re-sealable sandwich bag.

The pocket is preferably of polymer construction. Examples of suitable polymers include, but are not limited to, PVC, polyethylene, polypropylene, polystyrene, and the like with the polyethylene being preferred. The pocket is preferably clear or transparent, but can be tinted, translucent, or opaque.

Desirably, the pocket and banner are of the same polymer composition so that they can heat-seal to each other, but they also may be of different compositions if they are heat-sealing compatible, i.e. will stick together. Sealing methods which may be employed to heat the polymer include but are not limited to conductive, convective, radiant or high-frequency electromagnetic heat energy. In accordance with a preferred aspect of the present invention, high-frequency electromagnetic energy is used to seal the pocket to the banner. As used herein, "high-frequency electromagnetic energy" refers to utilizing electromagnetic energy in frequencies of 0.1 to 30,000 MHz. This includes the ultrasonic frequency range (18 KHz–1000 KHz), the radio frequency (RF) range (1 MHz–300 MHz), and the microwave (MW) frequency range (300 MHz–10,000 MHz). The present invention generally utilizes radio frequency in the range from 1 to 300 MHz, desirably from 1.5 to 200 MHz, and preferably from 15 to 40 MHz.

Various polymers are not suitable, or at least not well suited, for high-frequency heating operations. In such ill-suited polymers, high-frequency heating either does not occur, or if it occurs, it does so only after inefficiently prolonged periods of treatment time. In production assembly lines, a quick heat-seal operation is generally preferred over a prolonged heat-seal operation.

Among the polymers which are ill-suited for high-frequency heating are olefin polymers, e.g., polymers and copolymers of ethylene, propylene, and other α-olefinically unsaturated hydrocarbons having from about 2 to about 10 carbon atoms, styrene, PVC, and the like. Polyethylene is particularly known in the art to be substantially unsuitable for high-frequency heating unless sensitizers are added to the polymer; this is true regardless of whether it is linear or branched, or of whether it is low, medium, or high density (see e.g., U.S. Pat. Nos. 3,336,173; 3,640,913; and 3,810,799). Some of these olefin polymers can contain polar groups, or polarizable groups, due to the incorporation therein of, e.g., acrylic (or methacrylic) acids or their alkyl esters. Such groups, at high levels of incorporation, tend to impart a modicum of high-frequency heatability to the polymer, but the efficacy is generally slight so that it is not feasible on a commercial basis.

Some polymers having polar groups, e.g. chlorinated P.E., ethylene/vinyl acetate copolymer, PVC, polyvinylidene chloride, polyurethane and polyamide, are heatable under the influence of certain frequencies of electromagnetic radiation. Such polymers can be used as a heating sheet to heat other polymers which are not as readily heatable under the influence of RF energy. The conductive energy created by the heating sheet is used to bond the pocket to the banner. A polyvinyl chloride heating sheet is preferred. The preferred heating sheet has a higher melting point than the banner and pocket polymers and is not bonded or sealed thereto, and because dissimilar polymers will not bond usually.

Figure 2:
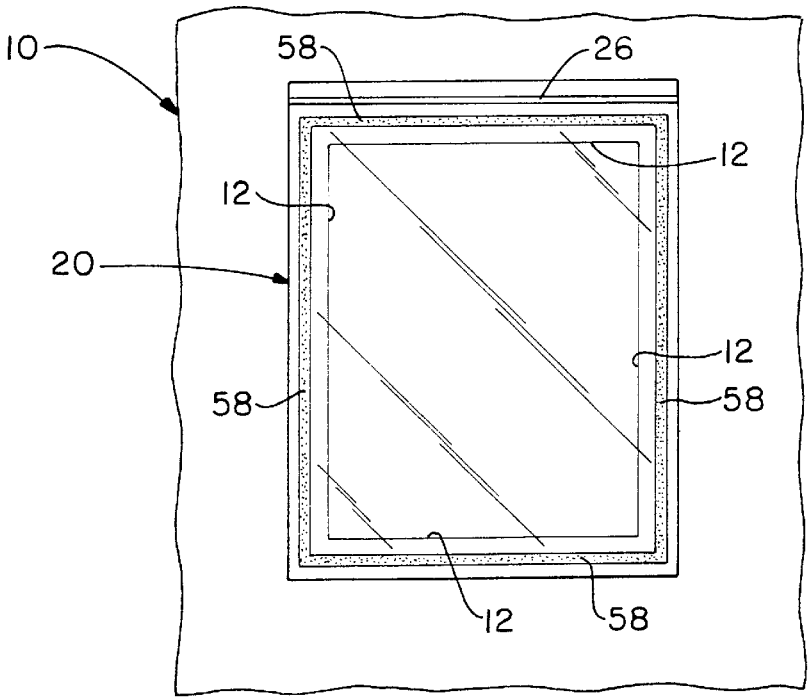
FIG. 2 is a rear elevation view showing a pocket high-frequency sealed to a the periphery of the window in the banner. The high-frequency sealed area is visible in the drawing.
Figure 3:
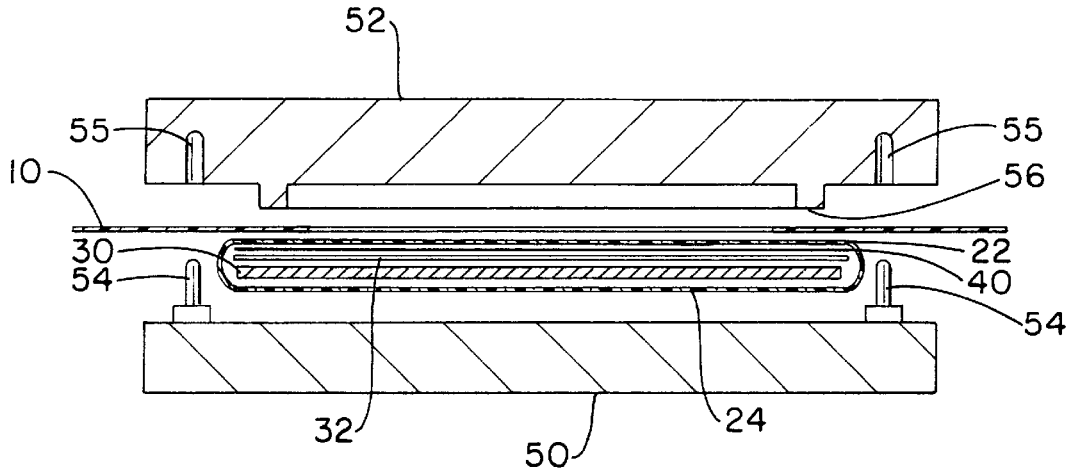
FIG. 3 is a cross-sectional side view of a portion of the apparatus used to heat-seal the banner to a pocket showing the various layers utilized to seal the pocket to the banner. The pocket contains a heating sheet closest to the first wall of the pocket, which will be sealed to the banner. The pocket also comprises a Mylar™ (polyester) and aluminum barrier which protects and insulates the second wall of the pocket which will not be sealed. Optional locating pins which may guide the sealing process are shown. The top and bottom press plate of a platen press are also shown.
Figure 4:
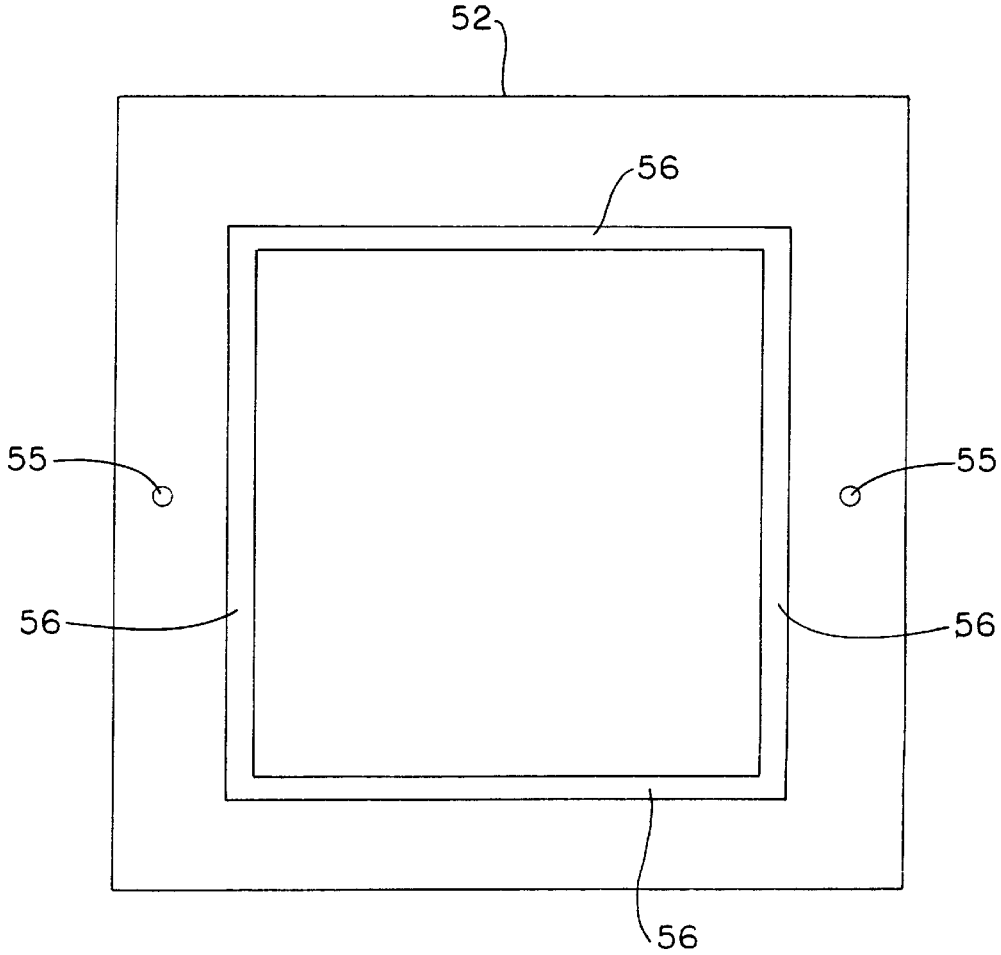
FIG. 4 is a bottom elevation view of a top press plate. The top press plate contains a heat-sealing die element which is used to seal the pocket to a banner.

In one embodiment of the present invention, generally shown in FIGS. 1, 2 and 3, portions of a first wall 22 of a polyethylene pocket 20 are RF sealed to polyethylene banner 10. Accordingly, a banner, optionally with or without printed indicia 14, is cut preferably with a die, but any other cutting method such as with a laser, may be empoloyed to create an opening in an area, preferably inside the perimeter area of the banner where pocket 20 having resealable opening 26 will be attached. The size of the window or hole 12, is roughly equal to and preferably less than the length and width dimensions of the pocket that will be sealed to it. A banner may have windows placed in more than one area if a plurality of pockets are to be attached. The pocket is sealed to the banner in the area along the periphery or border that results from placing or cutting a hole or window in the banner.

In the embodiment of FIGS. 1 and 2, only portions of the first wall 22 of pocket 20 are sealed to the banner 10. These portions correspond directly with the shape or configuration of the RF sealing die utilized. Optionally, but desirably, an insulating barrier is placed in the pocket in order to prevent the second wall from being affected, i.e., also sealed to the banner, by heat generated from the sealing process. Barrier 30 comprises an insulating material such as a piece of metal, wood or plastic with aluminum being preferred. A buffer sheet 32, optionally, but desirably is also used to insulate, and thus keep heat in the desired bond area. The buffer sheet can be Mylar™, a polyester, Teflon™, fish paper, HI-SEAL™, and the like, or combinations thereof. The buffer sheet can simply be placed on heat barrier 30 or adhered thereto. The barrier is inserted into the pocket from the open end. Generally, barrier 30 is narrower than the width of the bag to facilitate ease of insertion and removal but is at least as wide as the area on the first wall of the pocket that is to be sealed to the banner to insulate the remaining or second side of the bag from heat. The barrier can be longer than the open length of the pocket. The barrier can be in the form of a jig, which has a pattern which allows for the sealing of more than one pocket at a time to a banner.

One example of a method for sealing a pocket to the banner is as follows: A heating sheet 40 is placed between the barrier 30, which has been inserted into the pocket, and the first wall 22 of the pocket 20. The heating sheet length and width dimensions are equal to or less than the inside dimensional length and width of the pocket but is at least as large as the area on the first wall of the pocket that is to be heat sealed to the banner. The pocket assembly containing the heating sheet 40 and the optional barrier 30 and optional buffer sheet 32 is positioned on the bottom platen 50 of a press.

Referring to FIG. 3, the first wall of the pocket 22 is the upper most layer of the pocket assembly. Heating sheet 40 is located below the first wall. Barrier 30, if present, is located below optional buffer sheet 32. The bottom layer is the second wall of the pocket 24, which is in contact with the bottom of press 50. The banner is then positioned over the pocket assembly. Locating or mounting pins 54 and holes 55 can optionally be used to position the banner and/or jig. The upper platen containing a high-frequency heat-sealing die element, preferably an RF sealing die element 56, is lowered into the proper position. The sealing die element typically is aluminum, brass, or the like which can be used to emit high frequency energy along its dimensions. Sealing die 56 naturally is large enough to overlay the perimeter of the pocket area to be heat-sealed. That is, the sealing die is at least as large as and preferably slightly larger than the window, cutout area of the banner so that it covers a desired area on both the pocket and banner that will be sealed together, and thus provide a strong seal. A suitable width of sealing area 58 or perimeter can generally be of from about 1/32 to about 1 inch, and preferably of from about 1/8 of an inch to 5/8 of an inch.

The high-frequency RF energy heats heating sheet 40 which in turn heats the polymer surfaces of the pocket and banner that are to be sealed. Since the heating sheet has a higher melting point than the banner and pocket, the pocket and banner are heat sealed, fused, or melted together while the heating sheet does not stick or seal because it is a different polymer. After being subject to RF energy for suitable amount of time such as from about 0.5 seconds to about 5 seconds or more, the banner having a pocket attached thereto is removed from the press. Barrier 30 and buffer sheet 32, if utilized, along with heating sheet 40 are removed from the pocket. The end result is one embodiment of the present invention, a banner having the appearance of a "window", where the pocket has been sealed thereto. The pocket can then be filled with supplemental signage 60.

Figure 5:
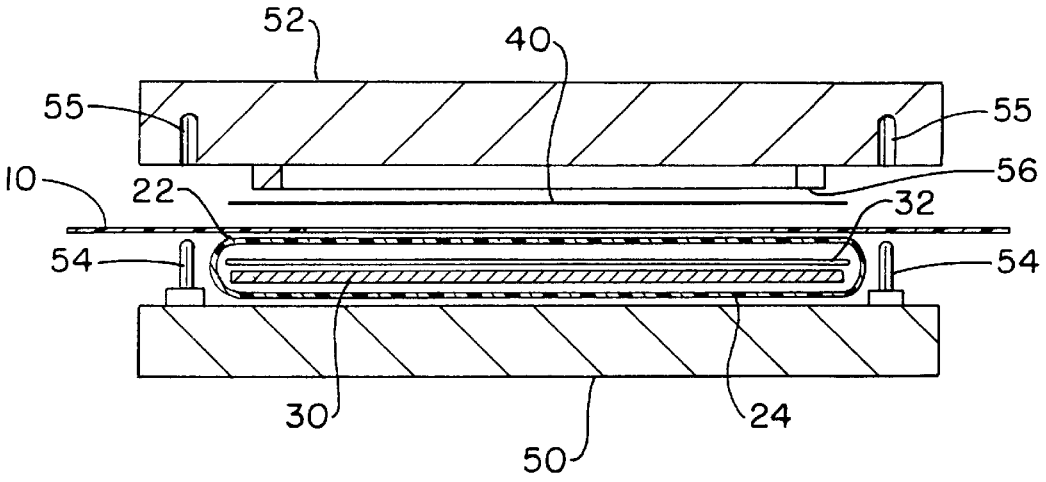
FIG. 5 is a cross-sectional side view much like FIG. 3, wherein the heating sheet has been placed on the banner instead of in the pocket. For thick thermoplastics, two heating sheets could be used, one in the pocket and one on the banner.

Another embodiment of a method for heat-sealing a pocket to a banner is follows, as can be seen from FIG. 5:

A barrier 30 and buffer sheet 32, optionally are positioned inside pocket 20 between first wall 22 and second wall 24. Banner 10 is placed over the pocket assembly in the platen press. Locating or mounting pins 54 and holes 55 can optionally be used to position the banner and/or banner jig. Heating sheet 40 is placed over banner 10 so that it covers the desired area on the banner that will be heat-sealed to the pocket. The sealing die elements 56 of the top platen 52 is lowered into position and RF energy is applied. After a sufficient amount of time has passed, thus ensuring the banner is sealed to the first wall of the pocket, the RF energy is discontinued and the banner with pocket sealed thereto is removed from the press resulting in an embodiment such as seen in FIGS. 1 and 2.

In yet another embodiment, generally if a relatively thick thermoplastic is being used as a pocket and/or a banner, heating sheets may be placed inside the pocket between the barrier and the first wall, as well as on top of the banner between the banner and the press. The heating sheet 40 may alternatively be placed between the banner 10 and die 56 as can be seen from FIG. 5.

In a further embodiment, at least one pocket is sealed in a similar manner to the front of a banner that has not been die cut. Preferably the banner does not have any printing in the area to be heat-sealed, as it could interfere with the heat-sealing process. Alternatively, pockets can be heat-sealed to both the front and back sides of a banner, if desired.

Furthermore, when sealing a banner and pocket of a thermoplastic composition, which is readily heatable under RF energy, no heating sheet is needed. For example, when a vinyl pocket is sealed to a vinyl banner using the above method, but no heating sheet is required.

There are numerous advantages to heat-sealing the pocket to the bag. By sealing pockets and banners of the same polymer together, they flex and bend at the same rate, thereby preventing stress at the joint areas and allowing for a long life. Moreover, the banner and pocket are more easily recycled and cold cracking is less likely to occur. No adhesive or tape is used to secure the pocket to the banner. Without adhesive or tape there can be no de-lamination of the banner and pocket. Moreover, solvents are not used that could pucker or weaken the banner.

Sealing a pocket or pockets to the backside of a die cut banner creates an aesthetic appeal. It hides the pocket top or zipper flaps from view and offers a cleaner-looking and neater window style banner. The pocket further allows for convenient easy changeability of supplemental signage. The pocket importantly is weatherproof if a sealable pinch or other type pocket is used.

In the foregoing description, certain terms have been used for brevity, clarity, and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

While in accordance with the patent statutes the best mode and preferred embodiment have been set forth, the scope of the invention is not limited thereto, but rather by the scope of the attached claims.

What is claimed is:

1. A thermoplastic advertising banner, comprising:

a banner having an opening therein; and at least one pocket, said pocket comprising at least two panels which have been substantially secured to each other to form said pocket, said pocket having a resealable opening, and said pocket being directly heat sealed to one side of said banner substantially about said opening of said banner.

2. The thermoplastic advertising banner of claim 1, wherein said banner opening has a periphery, and wherein said pocket is heat sealed to said banner substantially about said periphery.

3. The thermoplastic advertising banner of claim 2, wherein said banner is made from polyolefin, polyvinyl chloride, or polystyrene, or combinations thereof, and independently wherein said pocket is made from polyolefin, polyvinyl chloride, polystyrene, or combinations thereof.

4. The thermoplastic advertising banner of claim 3, wherein RF energy is utilized to heat-seal said banner to said pocket.

5. The thermoplastic advertising banner of claim 2, wherein said pocket is made from polyethylene, wherein said banner is made from polyethylene, and wherein one panel of said pocket is sealed to said banner substantially about said banner opening periphery.

6. A banner comprising:

at least one supplemental signage pocket, said pocket having at least two panels substantially secured to each other to form said pocket, said pocket having a periphery; and a banner having a front side, a back side, and at least one window opening, said window opening being generally smaller than the periphery of said pocket, said pocket located and sealed to said back side of said banner, said pocket having at least one of said at least two panels which is transparent.

7. The advertising banner of claim 6, wherein one panel of said pocket is sealed to said banner substantially about said banner window opening.

8. The advertising banner of claim 7, wherein RF energy is utilized to heat seal said banner to said pocket.

9. The advertising banner of claim 6, wherein said pocket is made from polyolefin, polyvinyl chloride or polystyrene, and wherein said pocket is a pinch bag or a slider top pocket.

10. An advertising banner having window-style supplemental signage pockets, comprising:

a banner, said banner having at least one window therein, said window having a length and a width defining an opening;

at least one pocket, said pocket having at least two walls, said walls being substantially secured to each other to form said pocket, said pocket located on one side of said banner wherein one of said pocket walls is heat sealed to said one side of said banner substantially about said window opening.

11. The advertising banner of claim 10, wherein said banner is made from a polyolefin, polyvinyl chloride, or polystyrene, or combinations thereof, and independently wherein said pocket is made from a polyolefin, polyvinyl chloride, or polystyrene, or combinations thereof.

12. The advertising banner of claim 10 wherein said pocket and said banner are made from polyethylene.

13. The advertising banner of claim 12, wherein RF energy is utilized to heat-seal said banner to said pocket.

* * * * *